US005117239A

United States Patent [19]

Riza

[11] Patent Number: 5,117,239

[45] Date of Patent: May 26, 1992

[54] REVERSIBLE TIME DELAY BEAMFORMING OPTICAL ARCHITECTURE FOR PHASED-ARRAY ANTENNAS

[75] Inventor: Nabeel A. Riza, Clifton Park, N.Y.

[73] Assignee: General Electric Company, Schenectady, N.Y.

[21] Appl. No.: 690,421

[22] Filed: Apr. 24, 1991

[51] Int. Cl.[5] ..... H01Q 3/22

[52] U.S. Cl. ..... 342/375; 342/158

[58] Field of Search ..... 342/375, 54, 157, 158

[56] References Cited

U.S. PATENT DOCUMENTS 4,929,956 5/1990 Lee et al. ..... 342/376

OTHER PUBLICATIONS

D. Dolfi, F. Michel-Gabriel, S. Bann, J. P. Huignard, "Two-Dimensional Optical Architecture for Time-Delay Beam Forming in a Phased-Array Antenna", vol. 16, Optics Letters, pp. 255-257 (Feb. 15, 1991).

D. Dolfi, J-P Buignard, M. Baril, "Optically Controlled True Time Delays for Phased Array Antenna", SPIE vol. 1102-Optical Technology for Microwave Applications IV (1989).

E. N. Toughlian, H. Zmuda, "A Photonic Variable FR Delay Line for Phased Array Antennas", IEEE Manuscript Report #0733-8724/90/1200 (1990).

*Primary Examiner*—Theodore M. Blum

*Attorney, Agent, or Firm*—Donald S. Ingraham; James C. Davis, Jr.; Marvin Snyder

[57] ABSTRACT

A phased array antenna system has optical architecture comprising free space delay units and associated spatial light modulators compatible for operation with temporally incoherent or coherent laser light to produce signals having selected time delays to actuate antenna elements of an antenna array to transmit electromagnetic radiation at a selected beam angle from the phase array. The same optical architecture is used to process electromagnetic signals detected by the antenna array to produce an output signal for display or processing which corresponds to the radiation detected at the selected beam angle.

21 Claims, 2 Drawing Sheets

REVERSIBLE TIME DELAY BEAMFORMING OPTICAL ARCHITECTURE FOR PHASED-ARRAY ANTENNAS

BACKGROUND OF THE INVENTION

This invention relates generally to signal processing systems and more particularly to beamforming controls for phased array antennas.

Phased array antenna systems employ a plurality of individual antennas or subarrays of antennas that are separately excited to cumulatively produce a transmitted electromagnetic wave that is highly directional. The radiated energy from each of the individual antenna elements or subarrays is of a different phase, respectively, so that an equiphase beam front, or the cumulative wave front of electromagnetic energy radiating from all of the antenna elements in the array, travels in a selected direction. The difference in phase or timing between the antenna activating signals determines the direction in which the cumulative beam from all of the individual antenna elements is transmitted. Analysis of the phases of return beams of electromagnetic energy detected by the individual antennas in the array similarly allows determination of the direction from which a return beam arrives.

Beamforming, or the adjustment of the relative phase of the actuating signals for the individual antennas (or subarrays of antennas), can be accomplished by electronically shifting the phases of the actuating signals or by introducing a time delay in the different actuating signals to sequentially excite the antenna elements to generate the desired direction of beam transmission from the antenna.

Electronically shifting the phases of the actuating signals requires extensive equipment, including switching devices to route the electrical signals through appropriate hardwired circuits to achieve the desired phase changes. Electronic phase shifters are designed for use at a specific frequency and thus have significant drawbacks when employed in phased array antenna systems using broad band radiation. For example, most hardwired phase shifters are limited to frequency changes of 1% or less of the design frequency of the shifter in order to avoid beam squint, or the variation from the beam direction that would result with the same phase delay at the design frequency.

Optical control systems can be advantageously used to create selected time delays in actuating signals for phased array systems. Such optically generated time delays are not frequency dependent and thus can be readily applied to broadband phased array antenna systems. For example, optical signals can be processed to establish the selected time delays between individual signals to cause the desired sequential actuation of the transmitting antenna elements, and the optical signals can then be converted to electrical signals, such as by a photodiode array. Different types of optical architectures have been proposed to process optical signals to generate selected delays, such as routing the optical signals through optical fiber segments of different lengths; using deformable mirrors to physically change the distance light travels along a reflected path before being converted to an electrical signal; and utilizing free space propagation based delay lines, which architecture typically incorporates polarizing beam splitters and prisms.

The use of optical fiber segments to introduce delays requires the use of many optical switches and the splicing of numerous segments of fiber together. The costs of construction of such a device are substantial given the significant amount of design work and precision assembly work necessary to produce a device having the range and incremental steps of phase changes that are required in a typical system, such as for a phased array radar. The numerous switching and coupling elements also introduce very high optical losses in the beamforming circuitry, requiring significant optical power input. The structure of the circuitry makes it less compact and less rugged than other types of systems discussed below.

The deformable mirror system relies on the physical displacement of a mirror to effect the necessary time delay; an array of moveable mirrors allows the generation of a range of delayed optical signals. This type of system is less rugged and potentially prone to calibration errors given the requirement displacement of the mirror to achieve the small time delays required for the optical signals.

An optical architecture for a transmit-only control circuit utilizing coherent light in conjunction with free space delay units was proposed by D. Dolfi, F. Michel-Gabriel, S. Bann, and J. Huignard in the paper entitled "Two-dimensional optical architecture for time-delay beam forming in a phased-array antenna", Vol. 16, *Optics Letters*, pp. 255–57, Feb. 15, 1991. The system proposed by Dolfi utilizes a coherent beam of light from a laser which is directed through a cascade of free space delay devices comprising spatial light modulators, polarizing beam splitters and prisms. By selectively polarizing various light beams from the laser, the beams can be individually directed through one or more of the free space delay devices to introduce a time delay to the beam. The delayed beams are ultimately directed through an array of microlenses to photodiodes which convert the optical signals into electrical signals to actuate the transmission antenna. Dolfi does not suggest the use of his device for processing signals from returned beams detected by the antenna. Additionally, the use of coherent light necessitates the use of high quality optical components in the system to maintain the coherence of the light from the laser source in order to modulate the laser beam by interference between two coherent beams. Given the sensitivity of such components to motion, this type of a system is less rugged than systems relying on incoherent light, which do not use the interference phenomenon.

It is accordingly a primary object of this invention to provide an optical beamforming architecture that can both process signals to control beams transmitted from a phased array antenna and process signals from return beams detected by a phased array antenna.

It is another object of the present invention to provide an optical beamforming architecture that has low optical losses, and that is compact and rugged.

It is a further object of this invention to provide an optical architecture that can be operated with either incoherent or coherent optical signals.

SUMMARY OF THE INVENTION

In accordance with the present invention, optical architecture for beamforming in a phased array antenna system both processes the signals to control the antenna beam in the transmit mode and processes the signals generated by returned beams detected by the antenna array. The phased array antenna system comprises an antenna array having multiple antenna elements, an optical signal processing system coupled to the antenna array, a modulated laser source, and a post processing detection and display system. In the transmit mode, a plurality of incoherent light beams from an intensity modulated laser source are directed into the optical signal processing system where the individual light beams are differentially time delayed and then are converted to electrical control signals to excite the individual antenna elements in the array. The differentially delayed optical signals produce corresponding differentially delayed electrical control signals for the antenna elements.

The optical signal processing system directs input optical beams through a plurality of free space delay devices which selectively delay the beams. Each light beam is directed through a pixel of a spatial light modulator (SLM), which rotates the polarization of the incident light beam by 0 degrees or 90 degrees, dependent on the control voltage applied to the pixel. The spatial light modulator is coupled to the free space delay device which comprises a polarizing beam splitter (PBS) and a prism. The light beam passes directly through the PBS or is deflected at a right angle to its original path, dependent upon its polarization. The light beams passed directly through the PBS continue on to the next spatial light modulator in the cascade of free space delay devices that comprise the signal processing system. The deflected light beam travels through the prism coupled to the PBS before being reflected back into the PBS and deflected back onto the same path that the light beam was on prior to being deflected into the prism. The size of the prism, and hence the distance the reflected beam travels in passing through it, determine the amount of time delay that is imparted to the deflected beam. Control of the pixel voltages in the respective SLMs in turn determines the polarization of each light beam at the entrance to each free space delay device, thus allowing selection of the light beams that will have the polarization orientation that will result in the beam being deflected into the prism by the PBS and thereby delayed. At the end of the cascade of free space delay devices all of the now selectively delayed light beams, or optical control signals, are polarized along along a first direction before being directed to an output PBS that allows light of that polarization to pass to an array of photodiodes which convert the individual optical signals into correspondingly delayed electrical control signals. These electrical signals comprise the output energy of the signal processing system, which in turn is used to excite the individual antenna elements.

In the receive mode, the electrical signals generated by the antenna elements after detection of an incoming electromagnetic beam are directed to the signal processing system where they are converted to optical return signals by a laser diode array. The light beams are then switched into the circuit of free space delay mechanisms and pass through those devices, with the received signals from each antenna element following a selected path as described above with respect to the transmit mode. At the end of the cascade of the free space delay devices, the optical signals are polarized along a second direction before being directed to an output PBS which directs beams of that polarization to a photodiode detector assembly which adds the optical signals together and converts the combined optical signals to electrical signals for further processing or display. The same selection of delay sequences that determines the direction of a beam that is transmitted allows a particular direction to be viewed in the receive mode.

Figure 2:
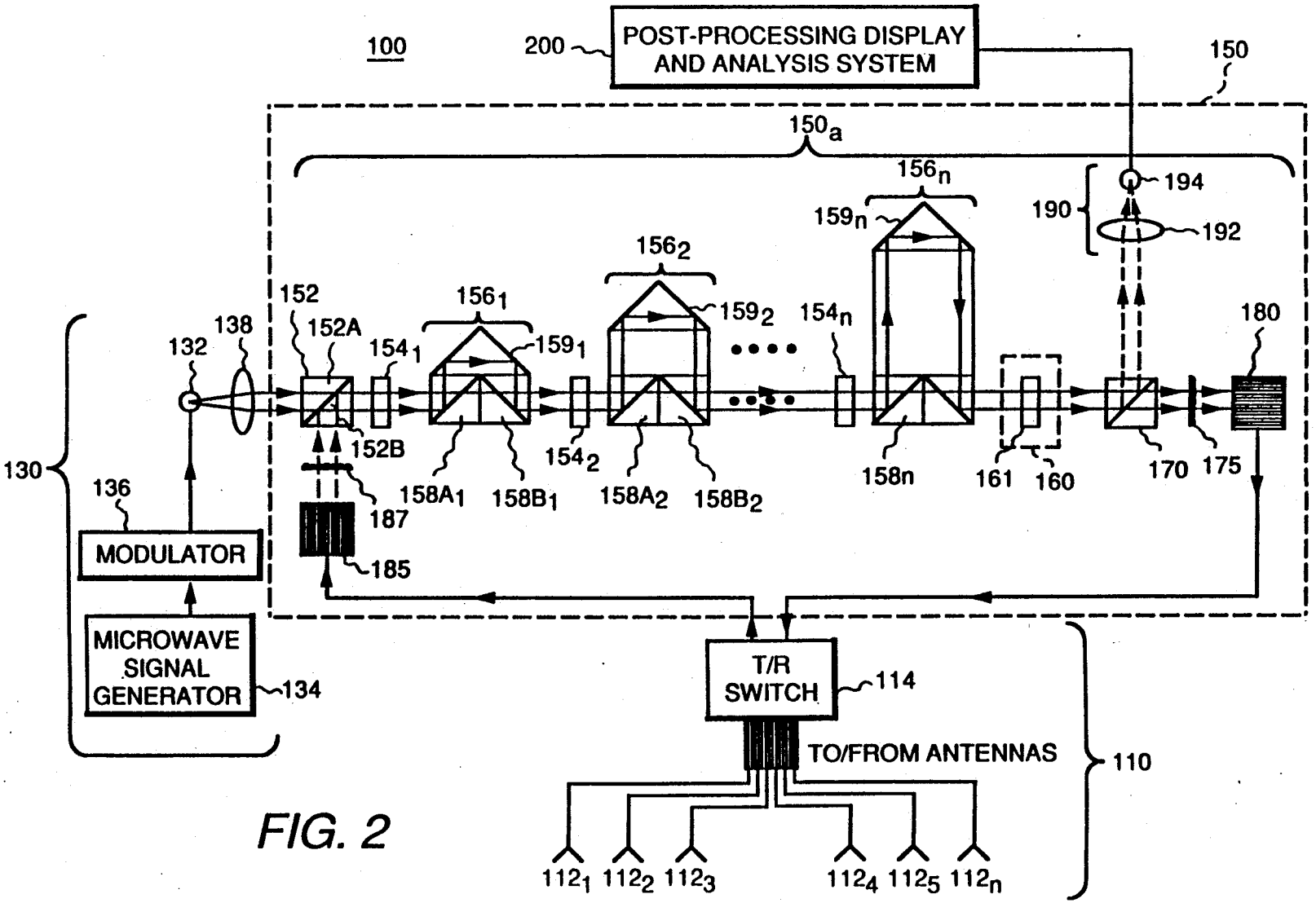

The FIG. 2 is a schematic representation of reversible time delay beamforming optical architecture and circuitry of the present invention.

Figure 3:
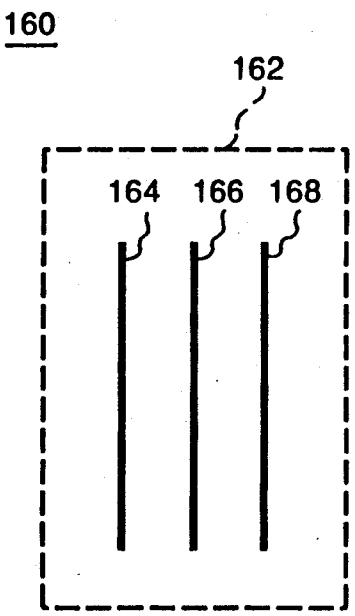

FIG. 3 is a schematic representation of an optical adder for use with the present invention.

DETAILED DESCRIPTION OF THE PREFERRED EMBODIMENT

Figure 1:
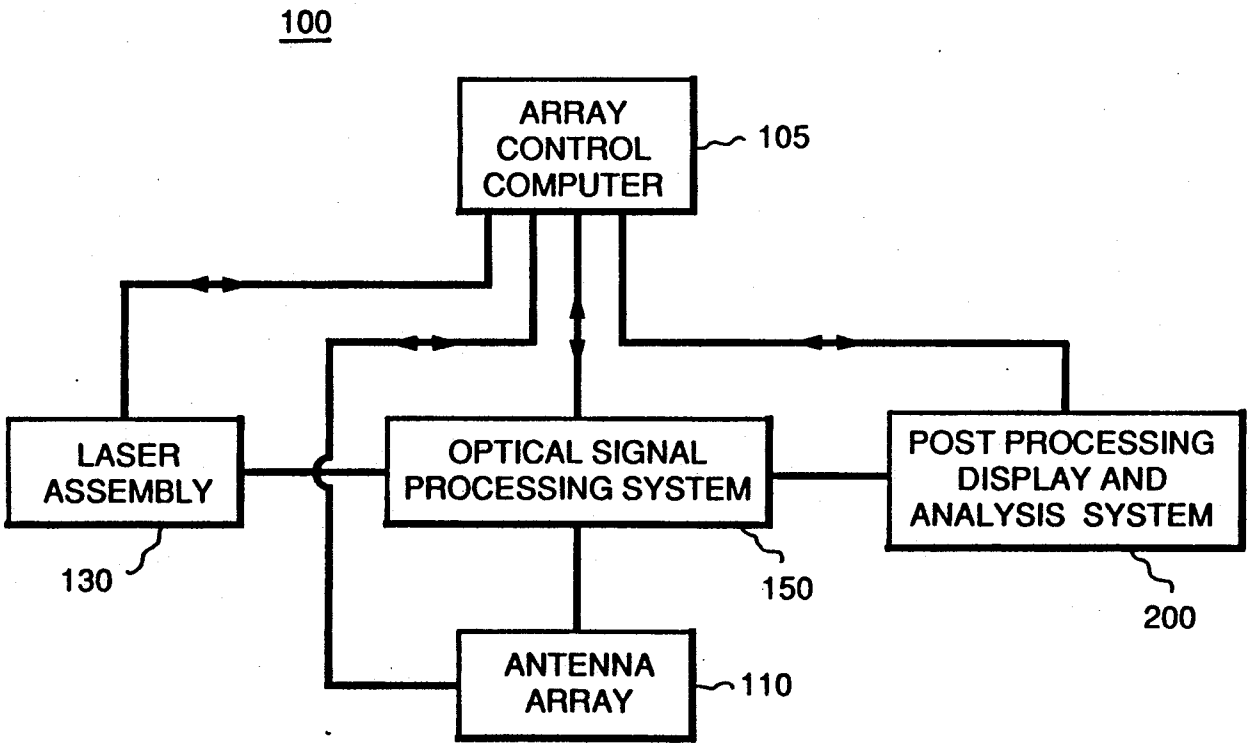
FIG. 1 is a block diagram of a phased array antenna system comprising the present invention.

In FIG. 1, a phased array antenna system 100 used as a radar or the like comprises an array control computer 105, an antenna array assembly 110, a laser assembly 130, an optical signal processing system 150, and a post-processing display and analysis system 200. Array control computer 105 is coupled to and generates signals to control and synchronize the operation, described below, of the components listed above so that antenna system 100 can operate in both a transmit and a receive mode with selected beamforming characteristics.

FIG. 2 illustrates in greater detail certain components of phased array antenna system 100. Electromagnetic energy is radiated by antenna array assembly 110 from a plurality of antenna elements 112 when the system operates in the transmit mode. As used herein, an antenna element may comprise one or more radiating devices (not shown) which, when excited by an electrical signal, radiates electromagnetic energy into free space. In a phased array system, the antenna elements may be arranged in any geometric pattern that provides the desired beamforming and detection capabilities for the array. Antenna elements 112 are commonly arranged in rows and columns and the optimum number of elements varies based on the intended use of the array. For example, in a typical phased array radar system for target tracking, more than 1,000 antenna elements are used in the array.

Antenna elements 112 are coupled to signal processing system 150 via a transmit/receive switch 114. Switch 114 is controlled by array control computer 105 (FIG. 1), which generates a control command to change the condition of switch 114 between a transmit position and a receive position in coordination with other control signals for the optical signal processing system and the like. In the transmit mode, switch 114 couples antenna elements 112 to the output control signals from signal processing system 150, which signal drive antenna elements 112 to radiate electromagnetic energy into free space. In the receive mode, the switch couples the antenna elements to the signal processing system to direct signals generated by antenna elements 112 in response to detected electromagnetic energy incident on the antenna elements, i.e. return signals, into the signal processing system.

Signal processing system 150 comprises optical architecture **150*a* to generate the time delays in the drive signals for antenna elements 112. As used herein "optical architecture" refers to the combination of devices for manipulating the direction, polarization, and/or the phase or time delay of light beams. Laser assembly 130 generates the light beams to provide an input signal to the optical architecture of signal processing system 150 to create the drive signals for antenna elements 112** in the transmit mode.

A laser source 132 is advantageously a semiconductor laser, but may be any type of laser beam generator that can provide beam intensities sufficient for operation of the the optical signal processing system as described in this application. Laser source 132 is modulated by a microwave signal generator 134 and a modulator 136 to produce laser pulses of the desired frequency for use with the phased array antenna system. By way of example and not limitation, direct linear intensity modulation can be used which results in the intensity of the modulated light being linearly proportional to the amplitude of the driving microwave signal voltage and current. Modulator 136 may comprise a square root/bias circuit to produce the desired direct linear intensity modulation.

Laser source 132 is optically coupled to a spherical lens 138 in which the modulated laser output light beam is divided into a plurality of individual light beams. As used herein, "optically coupled" to refers to an arrangement in which one or more light beams are directed from one optical component to another in a manner to maintain the integrity of the signal communicated by the light beams. Lens 138 also acts as an optical collimator to cause light beams passing from it to travel in parallel paths. The individual light beams into which the output beam of laser source 132 is divided provide the control signals for driving the individual antenna elements 112; thus the total number of beams into which lens 138 must separate the output beam of laser source 132 is determined by the number of antenna elements 112 which are to be driven by optical signal processing system 150.

Although a coherent or a temporally incoherent output of laser assembly 130 may be used in accordance with this invention, the preferred embodiment of this invention utilizes temporally incoherent light. As used herein, "temporally incoherent light" refers to laser light with a relatively broad spectrum, or poor coherence length. Thus, for the purposes of first describing the invention, it will be assumed that the optical output light beam of laser assembly 130 is temporally incoherent but polarized in a selected direction. For purposes of explanation, it will also be assumed that the output light beam of laser assembly 130 is polarized in the horizontal direction (p-polarized), although vertical (s-polarized) light can alternatively be used, so long as the particular polarization is selected for use in conjunction with the optical architecture as described below.

In accordance with the present invention, within the optical signal processing system 150 the plurality of light beams emerging from lens 138 are manipulated by the optical architecture to selectively time-delay individual light beams, and these individual light beams are converted into electrical signals having corresponding delays to drive antenna elements 112. Similarly, electrical signals generated by antenna elements 112 in the receive mode are converted to optical signals, manipulated by the same optical architecture, and reconverted to an electrical output signals which are directed to postprocessing display and analysis system 200 for operating a display or for further processing. For explanation purposes, the operation of the system in the transmit mode will be addressed first.

Laser assembly 130 is optically coupled to optical signal processing system 150. Temporally incoherent, polarized, and collimated light beams from laser assembly 130 enter processing system 150 at an input polarizing beam splitter (PBS) 152. PBS 152 allows light of a selected polarization to pass directly through the device, but light of an opposite polarization is deflected at a right angle to the incident angle of the light. For example, as illustrated in FIG. 2, input PBS 152 allows p-polarized light incident at side 152A from laser assembly 130 to pass directly through the device; oppositely (i.e. s-polarized) light incident at side 152B will be deflected 90 degrees.

Input PBS 152 is coupled to the first of a series, or cascade, of spatial light modulators (SLMs) $\mathbf{154_1}$–$\mathbf{154_n}$ and associated free space delay devices $\mathbf{156_1}$–$\mathbf{156_n}$. SLM $\mathbf{154_1}$ is a two-dimensional pixelated electrically addressed ferroelectric liquid crystal/polymer device typically having pixels arranged in columns and rows forming an array of A×B pixels. The pixels in this array are individually illuminated by light beams arranged in a corresponding A×B matrix, which light beams emerge from lens 138 and pass through input PBS 152. The SLM can alternatively be a nematic liquid crystal parallel rub device operated in the high speed transient nematic mode. Each pixel in SLM $\mathbf{154_1}$ acts as a polarization rotator, rotating the polarization of the incident light beam by 0 or 90 degrees (e.g., if the pixel is selected to cause rotation of the polarization orientation of incident light, p-polarized light would be rotated to s-polarized light and vice versa). The selection of control voltages applied to the pixel determines the orientation of liquid crystals in the cell which in turn determines whether the polarization orientation of light passing through the cell will be rotated. The polarization of each of the incident light beams can be selectively adjusted by changing the control signals to the pixel array of an SLM. Such control signals are provided by array control computer 105.

SLM $\mathbf{154_1}$ is optically coupled to an associated free space delay unit $\mathbf{156_1}$. As used herein, an "associated free space delay device" refers to sequentially adjacent SLMs and free space delay units in the cascade of these devices, i.e. SLM $\mathbf{154_1}$ and free space delay unit $\mathbf{156_1}$, SLM $\mathbf{156_2}$ and free space delay unit $\mathbf{156_2}$, etc. Each free space delay unit comprises a pair of polarizing beam splitters optically coupled to a prism, into which a light beam is deflected if it is to be time delayed in that free space delay unit. For example, light beams emerging from SLM $\mathbf{154_1}$ are incident on delay unit $\mathbf{156_1}$ and first enter a polarizing beam splitter (PBS) $\mathbf{158A_1}$. Dependent on the polarization of the incident light beams, the beam either passes directly through PBS $\mathbf{158A_1}$ into PBS $\mathbf{158B_1}$ and continues in the same direction to the next SLM in the cascade, or it is deflected by 90 degrees in PBS $\mathbf{158A_1}$. Light beams deflected 90 degrees enter a prism $\mathbf{159_1}$, in which the light beam traverses a path reflecting off walls of the prism before it is directed into PBS $\mathbf{158B_1}$, in which the light is again deflected by 90 degrees to rejoin the path on which it was travelling at the time it entered free space delay device $\mathbf{156_1}$. As a deflected beam will have travelled a greater distance in passing through the prism as compared to a companion beam that was not deflected by PBS $\mathbf{158_1}$,it will have a slight time delay with respect to the undeflected beam.

SLM $\mathbf{154_2}$ is optically coupled to free space delay unit $\mathbf{156_1}$ so that light beams passing out of free space delay unit $\mathbf{156_1}$ will illuminate the A×B pixelated array of SLM $\mathbf{154_2}$. The polarization orientation of each light beam can again be selected by controlling the pixels to either rotate or not rotate the light beam. SLM $\mathbf{154_2}$ is optically coupled to associated free space delay unit $\mathbf{156_2}$, which comprises PBS pair $\mathbf{158A_2}$ and $\mathbf{158B_2}$ and prism 159(2). Free space delay unit $156_2$ acts on the plurality of p- and s-polarized light beams in a manner similar to that described above with respect to free space delay unit $156_1$, with the light beams being passed either directly through or deflected into prism $159_2$, dependent on the polarization of the individual beam. Prism $159_2$ typically provides a longer path for the light to traverse, thereby creating a longer delay time than would prism $159_1$ with respect to an underflected beam. Similarly, each subsequent free space delay unit in the cascade would create a longer time delay in a deflected light beam.

The cascade of associated SLMs and free space delay units, up to "n" such associated groups, affords the opportunity to produce $2^n$ different delay values for light beams passing through optical signal processing system. Time delays for individual beams are determined by the number of free space delay units in which the beam is deflected through the prism and the length of the path that the light beam travels through each of the prisms (determined, for example, by the physical size of the prism).

The last free space delay unit $156_n$ in the cascade is optically coupled to an optical adder 160 which produces output light beams, with each of the light beams having the same polarization. An output SLM 161, which is capable of selectively rotating the polarization orientation of individual light beams passing through its A×B pixelated display, is advantageously used for this purpose. As the polarization orientation of each of the light beams at the output of free space delay unit $156_n$ is determinable based upon the orientation shifts made as the beams passed through the cascade of SLMs and associated free space delay devices, the pixel control voltages are adjusted on output SLM 161 to rotate light beams to a selected polarization orientation, such as p-polarity. Light beams already having the selected polarization orientation pass through output SLM 161 unrotated; thus all light beams emerging from SLM 161 have the selected polarization orientation.

Optical adder 160 may alternatively comprise a polarization rotation unit 162, as illustrated in FIG. 3. Components of rotation unit 162 include a 45-degree oriented polarizer 164, which effectively combines both p- and s- polarized beams, albeit at the reduced intensities seen at 45 degrees relative to the polarization axes of the respective beams. A half wave plate 166 is optically coupled to 45 degree polarizer 164 to receive light emerging therefrom. Half wave plate 166 shifts the 45 degree oriented uniform polarization to a selected polarization orientation, for example p-polarized orientation. A liquid crystal cell 168 is optically coupled to half wave plate 166 and, dependent upon the applied voltage, allows light to pass through with its polarization orientation unchanged or selectively rotates the p-polarized light exiting half wave plate 166 to s-polarized light.

An output polarizing beam splitter 170 is optically coupled to a focusing lenslet array 175 and to a detector assembly 190. Dependent upon the polarization of the incident light, output PBS 170 causes the light beams to be directed to a photodiode array 180 via lenslet array 175, or to detector assembly 190. For example, in the transmit mode, each of the plurality of light beams emerging from uniform polarization unit 160 is p-polarized and will pass through output PBS 170 to be coupled with photodiode array 180.

Photodiode array 180 comprises an array of A×B photodiodes corresponding to the plurality of light beams emerging from output PBS 170. The optical control signals, or light beams, incident on array 180 are converted to electrical signals. The electrical signals generated by photodiode array 180 are delayed by time intervals corresponding to the time delays imparted to the optical control signals; these electrical signals are connected through transmit/receive switch 114 to antenna elements 112, which, when excited by the electrical signals, radiate electromagnetic radiation into free space in the desired direction.

In accordance with the present invention, optical signal processing system 150 processes both signals for use in the transmit mode and signals for use in the receive mode. The optical architecture described above, from input PBS 152 to output PBS 170, operates in the same fashion in the receive mode as described above with respect to the transmit mode. Signal processing system 150 comprises a laser diode array 185 and a detector assembly 190 which are used in the receive mode as described below.

Laser diode array 185 is electrically coupled to transmit/receive switch 114 and optically coupled to input PBS 152 via a collimating lenslet array 187. Laser diode array 185 comprises a plurality of laser diodes arranged in an A×B array corresponding to the array pattern used in the optical architecture for processing the transmit signals. The laser diodes may be of any type that are capable of producing a laser light pulse of an intensity and frequency compatible with the optical architecture, in response to the electrical signals received from transmit/receive switch 114. In operation, electrical return signals generated by antenna elements 112 in response to detected electromagnetic radiation are electrically conducted to laser diode array 185 which converts the electrical signals into corresponding optical return signals. The polarization orientation of light beams generated by laser diode array 185 is selected to result in light of that polarization being deflected, upon reaching input PBS 152, into the cascade of SLMs 154 and free space delay units 156. The paths followed by individual light beams passing through the cascade is selected as described above with respect to the optical signals processed in the transmit mode.

Output PBS 170 is optically coupled to photodiode detector assembly 190, which comprises a combining lens 192 and an optical detector 194. Combining lens 192 focuses the plurality of light beams onto detector 194 which converts the combined optical return signals into an electrical return signal, the strength of which depends on the instantaneous relative time delays between the different beams incident on detector 194 and the instantaneous intensity of the combined light beams on detector 194. Detector 194 is electrically coupled to post-processing display and analysis system 200 for producing a display or for further processing of the signal information. When optical signal processing system 150 is operating in the receive mode, as directed by array control computer 105, uniform polarization unit 160 selectively rotates each of the light beams to have, for example, an s-polarization, in which case the light is deflected by output PBS 170 to detector assembly 190.

In the receive mode, phased array antenna system 100 is used to "view" a particular angle of space with respect to the antenna array to determine the intensity of electromagnetic radiation of the desired frequency being received from that direction. In a radar system, for example, the strength or intensity of the radiation received from a given angle determines whether a target is detected in that direction. The time delays set in the cascade of free space delay units and associated SLMs determine the beam angle of the phased array antenna in either a transmit or a receive mode. Thus, in the receive mode, only the sum of the signals detected by the antenna array from a selected direction is necessary to determine the presence of reflected electromagnetic radiation from that beam angle.

Operation of the optical signal processing system may alternatively be accomplished through interference and heterodyne detection using coherent laser light. Such operation would necessitate using the appropriate equipment (not shown) in laser assemblies 130 and 180 to create two mutually coherent laser beams. This arrangement would require, for both transmit and receive operations, that the phase of the output light beam of laser assembly 130 be locked with that of the output beams of laser diode array 180. The locking can be accomplished through known frequency injection mode locking techniques used for temporally locking laser diodes. In the transmit mode, amplitude modulated laser 132 provides the signal beam, while laser diode array 185 operating in the continuous wave (CW) mode provides the reference beam for interference. In the receive mode, laser 132 operating in the CW mode provides the reference beam, while laser diode array 185, amplitude modulated by the received electrical signals from antenna array 112, forms the signal beam. The output beams from both laser 132 and laser diode array 185 are polarized in the same direction, for example p-polarized, and PBS 152 is replaced by a non-polarizing cube beam splitter (BS) (not shown). In this arrangement, half of the light from laser 132 and laser diode array 185 is directed toward SLM $154_1$, while half of the light is directed out of the BS to provide the mode-locking signals.

It will be readily understood by those skilled in the art that the present invention is not limited to the specific embodiments described and illustrate herein. Many variations, modifications and equivalent arrangements will now be apparent to those skilled in the art, or will be reasonably suggested by the foregoing specification and drawings, without departing from the substance or scope of the invention. Accordingly, it is intended that the invention be limited only by the spirit and scope of the appended claims.

What is claimed is:

1. A phased array antenna system comprising:

a plurality of antenna elements arranged in an array, said array being operable in a transmit or a receive mode;

an optical signal processing system coupled to said array, said system generating differentially time-delayed optical control signals to control output beam radiation patterns transmitted from said array and to optically process return radiation patterns detected by said array; and a modulated laser source optically coupled to said signal processing system and having means for dividing light from said laser source into a plurality of collinear light beams;

said optical signal processing system comprising:

a plurality of spatial light modulators optically coupled to associated free space delay units so as to selectively time delay each of said plurality of light beams, means for converting said optical control signals into corresponding electrical signals to excite said antenna elements in said transmit mode, means for converting electrical signals produced by said antenna elements in response to detected electromagnetic radiation in said receive mode into corresponding return optical signals, and means for converting said return optical signals after said optical processing into electrical signals.

2. The phased array antenna system of claim 1 wherein said means for dividing light from said laser source into a plurality of beams comprises a collimating lens.

3. The phased array antenna system of claim 1, wherein each of said free space delay units further comprises a pair of polarizing beam splitters optically coupled to a prism to provide a selected time delay to at least one of said plurality of light beams.

4. The phased array antenna system of claim 1 further comprising an optical adder to uniformly polarize each of said light beams emerging from said pluralilty of spatial light modulators and free space units.

5. The phased array antenna system of claim 4 wherein said optical adder comprises a spatial light modulator.

6. The phased array antenna system of claim 4 wherein said optical adder comprises a 45 degree oriented polarizer optically coupled to a half-wave plate.

7. The phased array antenna system of claim 6 further comprising a liquid crystal cell optically coupled to said half wave plate, said cell being coupled to selectively rotate the polarization orientation of incident light beams.

8. The phased array antenna system of claim 4 further comprising an input polarizing beam splitter to direct incident light of selected polarization orientations into said time delaying means.

9. The phased array antenna system of claim 4 further comprising an output polarizing beam splitter (PBS) optically coupled to receive light from said optical adder and optically coupled to transmit light of a first selected polarization orientation to said means for converting optical signals into corresponding electrical signals to excite said antenna elements and to transmit light of a second selected polarization rotation to said means for converting the processed optical return signals into electrical signals.

10. The phased array antenna system of claim 9 wherein said means for converting the processed return optical signals to electrical signals comprises a photodiode detector assembly.

11. The phased array antenna system of claim 10 wherein said photodiode detector assembly is optically coupled to said output polarizing beam splitter.

12. The phased array antenna system of claim 1 wherein said means for converting said optical control signals into corresponding electrical signals to excite said antenna elements comprises an array of photodiodes.

13. The phased array antenna system of claim 1 wherein said means for converting electrical signals generated by said array in said receive mode into corresponding return optical signals comprises an array of laser diodes.

14. The phased array antenna system of claim 1 wherein said light beams are comprised of temporally incoherent laser light.

15. The phased array antenna system of claim 1 wherein said light beams are comprised of coherent laser light.

16. The phased array antenna system of claim 1 wherein said modulated laser source comprises a semiconductor laser and means electrically coupled to said laser for direct linear modulation of said laser.

17. The phased array antenna system of claim 1 further comprising a transmit/receive switch to selectively electrically couple said antenna array to said means for converting optical control signals into corresponding electrical signals and to said means for converting electrical signals to corresponding optical return signals.

18. The phased array antenna system of claim 1 further comprising an array control computer coupled to said optical control system, said laser source, and said antenna array to control operation of said phased array antenna system in said transmit and said receive modes.

19. A phased array radar system comprising:

an array control computer, an antenna array having a plurality of elements, said array being operable in a transmit or receive mode, a post detection display and analysis system, a modulated laser source, and an optical signal processing system electrically coupled to said antenna array and said post detection display and analysis system and optically coupled to said laser source, said array control computer being coupled to said antenna array, said post detection display and analysis system, said modulated laser source and said optical signal processing system to control the combined operation thereof in said transmit and receive modes, said signal processing system comprising:

an optical architecture having an input polarizing beam splitter, a cascade of spatial light modulators and associated free space delay units to delay signals passing therethrough, said cascade being optically coupled to receive light beams from said input polarizing beam splitter, an optical adder optically coupled to said cascade to uniformly polarize light passing from said cascade, and an output polarizing beam splitter optically coupled to said adder, an array of photodiodes to convert time delayed optical signals passing from said optical architecture into corresponding electrical signals, an array of laser diodes to convert electrical signals generated by said antenna array in response to detected electromagnetic radiation into corresponding optical signals for application to said optical architecture, and a detector assembly optically coupled to said optical architecture to convert said optical signals into an electrical output.

20. The phased array radar system of claim 19 wherein each of said spatial light modulators and associated free space delay units in said cascade produce a time delay of different duration.

21. The phased array radar system of claim 20 wherein said laser source produces temporally incoherent light.

* * * * *